United States Patent [19]

Roux

[11] Patent Number: 4,691,146

[45] Date of Patent: Sep. 1, 1987

[54] METHOD FOR FORMING SPECIAL COLOR EFFECTS FROM A FLUORESCENT LAMP WHICH IS SUPPLIED WITH ELECTRICAL POWER AND A DEVICE FOR CARRYING OUT THE METHOD

[76] Inventor: Jacques Roux, 6 passage des Abbesses, 75013 Paris, France

[21] Appl. No.: 837,746

[22] Filed: Mar. 10, 1986

[51] Int. Cl.[4] ..... H05B 41/16

[52] U.S. Cl. ..... 315/287; 315/72; 362/806; 362/811

[58] Field of Search ..... 362/806, 811; 315/287, 315/363, 33, 72

[56] References Cited

U.S. PATENT DOCUMENTS

| | | | |
|---|---|---|---|
| 2,443,510 | 6/1948 | McCallum | 362/811 |
| 3,080,474 | 3/1963 | Allen | 362/811 |
| 3,569,775 | 3/1971 | Halsted | 315/287 |
| 4,286,195 | 8/1981 | Swinea, Jr. | 315/224 |
| 4,529,913 | 7/1985 | Brosillon | 315/224 |

FOREIGN PATENT DOCUMENTS

| | | |
|---|---|---|
| EP42362 | 12/1981 | Switzerland . |

*Primary Examiner*—Harold Dixon

*Attorney, Agent, or Firm*—Steinberg & Raskin

[57] ABSTRACT

The present invention relates to a method and a device for forming special color effects wth at least an electrical lamp which is supplied with a pulsed current and moved by a relative movement into space. The device supplies the electrical lamp with an electrical current which is pulsed during a time T1 in accordance with a pulsating period T, the cyclic ratio T1/T varying between 0 and 1 and the frequency 1/T varying from 1 to 500 Hz.

18 Claims, 2 Drawing Figures

METHOD FOR FORMING SPECIAL COLOR EFFECTS FROM A FLUORESCENT LAMP WHICH IS SUPPLIED WITH ELECTRICAL POWER AND A DEVICE FOR CARRYING OUT THE METHOD

BACKGROUND OF THE INVENTION

The present invention relates to a method and a device for forming special color effects induced from an electrical lighting element constituted for example by an incandescent lamp, a fluorescent or luminescent discharge lamp, with or without fluorescent material.

The use of especially fluorescent lamps is well known for lighting purposes, but, when supplied with electrical current, they emit only one color, for example white for a white fluorescent lamp.

SUMMARY OF THE INVENTION

The present invention proposes a method and a device allowing the obtention, in addition to the white color, of additional colors, such as the colors violet, green, yellow or other for a fluorescent lamp of white color supplied with an a.c. current.

For that, the method for forming special color effects from a lighting lamp preferentially a fluorescent lamp and supplied with an a.c. current, is characterized in that it consists in periodically supplying the lamp with the electrical current which is pulsed during an emitting time T1 of the electrical current such that a flashing occurs which is visible to an observer, selected so that the cyclic ratio T1/T, where T is the pulsating period, is comprised between 0 and 1, and whose corresponding frequency 1/T is comprised between 1 and 500 Hz; and moving the lamp in accordance with a relative moving speed V into space such as $0<V\leqq 50$ m/s or $0<V\leqq 50$ rps.

The device for carrying out the above method according to the invention is characterized in that it comprises a transformer supplying with electrical power the fluorescent lamp, whose electrodes are connected to the secondary winding circuit thereof; a power stage disposed in the primary winding circuit of the transformer; an oscillating circuit connected to the input of the power stage and generating thereto a fixed frequency current for supplying the lamp; a semi-conductor element capable of periodically operating the oscillating circuit during a time T1 and a generator for generating a square-wave signal, connected to the semi-conductor element which is rendered conductive during the time T1 selected so that the cyclic ratio T1/T where T is the period of the square-wave signal, is comprised between 0 and 1, the frequency of the square-wave signal being comprised between 1 and 500 Hz.

According to another feature of the invention, the device further comprises an adjustable oscillator delivering a triangular signal of relatively low frequency for controlling the square-wave signal generator, the frequencies of the triangular and square-wave signals being equal.

According to another feature of the invention, the triangular signal generator comprises a variable resistance for adjusting the cyclic ratio.

BRIEF DESCRIPTION OF THE DRAWINGS

For a full understanding of the invention, reference is made to the following description, taken in connection with the accompanying drawings, in which.

DESCRIPTION OF PREFERRED EMBODIMENTS

Figure 1:
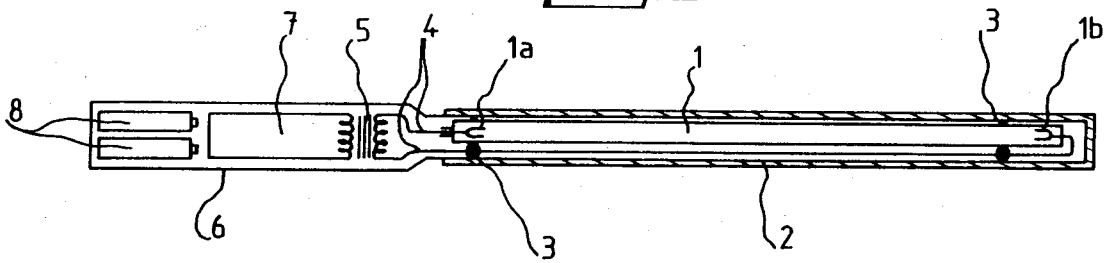
FIG. 1 is a schematic view of a fluorescent lamp supplied from electrical batteries and capable of being manually moved for forming special color effects.

Referring to FIG. 1, reference 1 designates a fluorescent lamp having its supplying electrodes 1*a*, 1*b* disposed at the two ends thereof, respectively.

The fluoreccent lamp 1 is a tubular lamp containing as internal gas, either argon with mercury vapour (mercury vapour being capable to be used alone), or neon, and has a deposition or settling of fluorescent powder on its internal surface. This fluorescent powder emits the characteristic color of the fluorescent lamp when the latter is supplied in the normal conditions.

For security purposes, the fluorescent tubular lamp may be housed inside a transparent or diffusing protecting tube 2 and firmly positioned in the latter via blocking annular rings 3.

The tube 2 is closed at one end and open at the other end thereof.

The electrodes 1*a* and 1*b* are respectively connected, through conductive wires 4, to the two terminals of the secondary winding of a voltage increasing transformer 5 housed within a portion 6 in the form of a longitudinal handle which is fixed in part in the open end of the protecting tube 2. Preferentially, the handle portion 6 has a circular cross-section.

In the handle portion 6 are also housed the electronic device 7 for powering, through the transformer 5, the fluorescent lamp 1 and supplying batteries 8 connected to the device 7.

The assembly constituted by the protecting tube 2 and the handle portion 6 is thus in the form of an autonomous and portable stick which can be manually moved.

As an example, the external diameter of the fluorescent tubular lamp 1 may be about 16 mm and the internal diameter thereof is about 14 mm, with a distance inter-electrodes 1*a* and 1*b* of about 40 cm.

Figure 2:
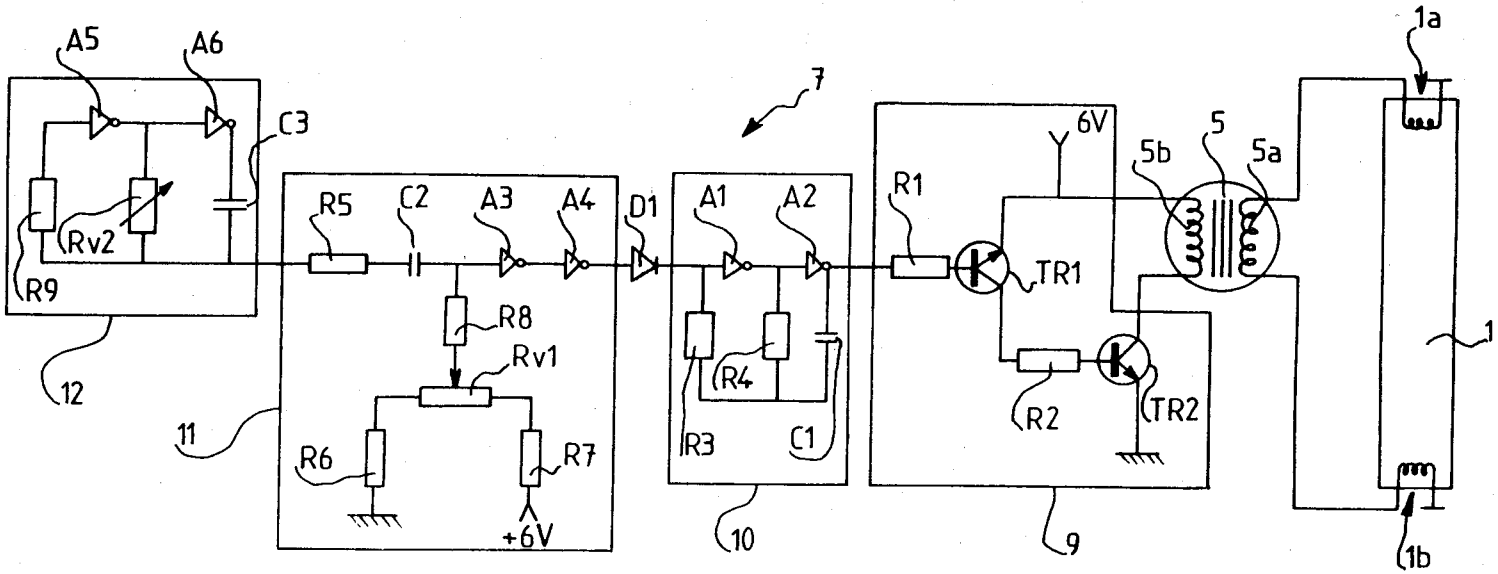
FIG. 2 shows the electronic circuit for supplying the fluorescent lamp according to the invention.

The electronic device for supplying the fluorescent lamp 1 according to the present invention is shown in FIG. 2.

This device comprises the transformer 5 for power supplying the fluorescent lamp 1, whose electrodes 1*a* and 1*b* are connected to the terminals of the secondary winding 5*a* of the transformer. The two terminals of the primary winding 5*b* of the transformer 5 are connected to a power stage 9 including two transistors TR1 and TR2. Transistor TR1 is of NPN type and has irts base electrode connected to an input resistance R1, its emitter electrode connected to one of the terminals of the primary winding 5*b* and its collector electrode connected to a base resistance R2 of transistor TR2. The latter, also of NPN type, has its emitter electrode connected to the ground and its connector electrode connected to the other terminal of the primary winding 5*b* of the transformer 5. The emitter of transistor TR1 is also connected to the positive potential of d.c. supply 8, of +6 V, for example.

An oscillating circuit 10 delivers to the input terminal of resistance R1 of stage 9 a signal of relatively medium or high frequency, according to the type of fluorescent lamps or lighting lamps used in the invention, this signal having for example a frequency of about 10 KHz. This a.c. signal is used for feeding or supplying the fluorescent lamp 1 through the power stage 9 and the transformer 5. The oscillating circuit 10 is constituted by two inverting amplifiers A1 and A2 connected in series, the output of amplifier A2 being connected to the resistance R1, and by two resistances R3, R4 and a capacitor C1 connected in common with one of their terminals, resistances R3 and R4 being respectively connected with their other terminals to the input and output of amplifier A1 while the other terminal of capacitor C1 is connected to the output of amplifier A2. Of course, the output current frequency of circuit 10 may be adjusted by only changing the values of resistances R3, R4 and of capacitor C1. Moreover, the inverting amplifiers A1 and A2 are of the type restituting to the output thereof the input signal which is supplied thereto, while inverting it.

A semi-conductor element, constituted in the present case by a diode D1, has its cathode connected to the input of inverter amplifier A1 while its anode is connected to the output of a generator circuit 11 which generates a square-wave signal. This generator comprises a resistance R5 and a capacitor C2 connected in series, with the capacitor C2 connected to the input of a voltage inverter amplifier A3 connected in series with another inverter amplifier A4, whose output is connected to the anode of diode D1. A voltage divider circuit formed with resistances R6, R7 and adjustable resistance RV1 connected in series, is connected between the ground and the +6 V potential. The slide contact of adjustable resistance RV1 is connected through a resistance R8 to the input of inverter amplifier A3. Generator 11 generates a square-wave signal, whose frequency 1/T is equal to the frequency of the signal from oscillating circuit 12 connected to resistance R5, and whose cyclic ratio T1/T where T1 is a time during which the square-wave signal is high and T is adjustable in accordance with the variable resistance RV1. For example, this cyclic ratio may vary from about 10 to about 90%.

The oscillating circuit 12 delivers to the input of generator circuit 11 a triangular signal of adjustable frequency, and preferentially a relatively low frequency comprised between about 1 to about 500 Hz. The adjustable oscillator 12 comprises two inverter amplifiers A5 and A6 connected in series, the output of amplifier A6 being connected to input terminal of resistance R5 of circuit 11 through a capacitor C3. A variable resistance RV2 is connected between input terminal of amplifier A6 and terminal common to capacitor C3 and resistance R5. To this common terminal is also connected a resistance R9, whose other terminal is connected to the input of amplifier A5.

It is to be noted that inverter amplifiers A1–A6 are in a same integrated circuit, which is for example the 4049 circuit of TEXAS INSTRUMENTS.

The operation of the supplying device of the fluorescent lamp according to the present invention results in part from the above description and will be described more in detail herebelow.

The adjustable oscillator 12 delivers to generator circuit 11 the triangular signal of relatively low frequency, which is adjusted with variable resistance RV2, which generator circuit generates a square-wave signal of a frequency (or period T) identical to that of the triangular signal and of a cyclic ratio T1/T defined by resistance RV1. During the time T1 where the square-wave signal is high, diode D1 is rendered conductive for allowing the oscillator 10 to generate a signal of relatively medium or high frequency to the input of power stage 9. This power stage 9 thus gives to the transformer 5 the necessary power for the starting of the fluorescent lamp which is then supplied with a.c. current.

Thus, during time T1 where diode D1 is rendered conductive, the fluorescent lamp 1 is supplied with a a.c. current of relatively medium or high frequency, and then, when diode D1 is non-conductive during time T2 where the square-wave signal from circuit 11 is low ($T2=T-T1$), oscillator 10 is then blocked and fluorescent lamp 1 is not supplied during time T2, this process being periodically repeated at period T. In other words, there is a strong lighting of fluorescent lamp 1 during emitting time T1 of a.c. current defined by its true intensity I1 and no lighting of this lamp during emitting time T2 of the a.c. current defined by its true intensity I2, with $0 \leqq I2 < I1$ such that a flashing occurs which is visible to an observer.

By selecting a cyclic ratio T1/T above to or equal to 0.05 but lower than 0.9, with a frequency 1/T of the square-wave signal above or equal to 10 Hz but below or equal to 50 Hz, and by manually moving the stick assembly of FIG. 1 in accordance with the moving or displacing speed below or equal to 5 m/s or by manually turning the stick assembly into space to a rotative speed below or equal to 10 rps, a color effect is produced from fluorescent lamp 1, in addition to its own color, the colors being visually observed by an observer distant from the person handling the stick.

As an example, very distinct visual color effects are produced with a white fluorescent lamp containing neon for a vaue of $T1/T=0.2$ and a frequency value $1/T=20$ Hz.

Moreover, the possible smaller width, corresponding to the direction of the displacement of the lamp, of the lighting portion seen by the observer is, the most spectacular is the color effect. Thus, if the fluorescent lamp 1 is manually moved as explained hereabove, this width will correspond to the external diameter thereof. If the tubular lamp has a diffusing protecting screen, the width will be that of the screen. In practice, a width below 40 mm is recommended, a width of about 15 mm is good while a width of 10 mm is excellent.

According to the invention, instead of manually moving or displacing the fluorescent lamp 1 as precedingly described, the latter may be fixed to a rotating plate or sheel, whose rotating speed is fixed or variable, the observer distant from the rotating plate then observing the same spectacular effect of colors observed in the case of the use of the stick assembly of FIG. 1. This effect is produced for a cyclic ratio T1/T such as $0<T1<1$ for a frequency 1/T such as $0<1/T<500$ Hz, with a rotation speed such as $0<V \leqq 50$ rps. These same values may be used in the case where the fluorescent lamp 1, instead of being rotated with a rotating plate, would be moved with an appropriate mechanical device along a path, rectilinear or not, at a speed V such as $0<V \leqq 50$ m/s.

The best results have been observed, in the case of a rotating plate or of the mechanical device displacing or moving along a rectilinear or not rectilinear path the fluorescent lamp, for the following values:

$0.2 \leqq T < 100$ Hz
$0.01 \leqq T1/T \leqq 0.99$
and $0<V \leqq 50$ m/s
or $0<V \leqq 50$ rps.

The invention has been described hereabove as only applied to the supply of a fluorescent lamp but it is obvious that identical results may be provided with other lighting lamps such as for example incandescent lamps having nevertheless a fluorescent material.

Moreover, the values precedingly indicated correspond to a spectacular effect from a supply with a d.c. voltage of 6 volts, but it is obvious that this voltage may vary while using the same electronic components of the device shown in FIG. 2. For example, a voltage of 12 volts will increase these effects (a stronger lighting, an increase of the tubular lamp length, etc. . . . ). Moreover, the device according to the present invention may also be supplied from d.c. current from the conventional network current instead of using the batteries 8 rendering the stick assembly portable. It is also possible to provide the protecting screen, protecting the fluorescent lamp, which is transparent or semi-transparent, colored or not.

On the other hand, the mechanical device capable of moving the fluorescent lamp along a path may be an oscillating type device.

In the case of a fluorescent lamp or luminescent lamp containing only a gas or a mixture of different gases, the presence of one or several fluorescent materials or settling form supplementary color effects due to the retentivity difference of the different materials during time.

As explained hereabove, the fluorescent lamp 1 moves with respect to an observer but it is obvious that the same color effect may be observed or seen in the case where the observer moves with respect to the fluorescent lamp or when there is an object which moves between the observer and the fluorescent lamp.

It is further to be noted that the characteristics in frequency and intensity of the a.c. current for supplying the fluorescent lamp are such that the latter does not need its conventional starting system for lighting it under the action of the emitted electrical current during time T1.

As way of example, the different components of the electronic circuit of FIG. 2 may have the following values: RV1 4700 ohms, RV2 470,000 ohms, R1 3300 ohms, R2 33 ohms, R3 1,000,000 ohms, R4 22,000 ohms, R5 560,000 ohms, R6 1800 ohms, R7 3300 ohms, R8 220,000 ohms, R9 1,000,000 ohms, C1 200 micro-farads, C2 1 micro-farad and C3 1 micro-farad. TR1 is BC 328 and TR2 is TIP 31A,D1 1N40148. A1–A4 are 4049 MOS. The characteristics of transformer 5 are such that its primary circuit has 35 windings for a wire diameter of 30/100 mm and its secondary circuit has 650 windings for a wire diameter of 10/100 mm, thus a voltage increase ratio of 18.5.

The device according to the invention is particularly intended for forming special color effects for theater carnivals, fun fairs, majorette sticks, systems of roads sign, electric signs, automotive equipments, luminous truncheon or others.

What is claimed is:

1. A method for forming special color effects from a lighting lamp preferentially a fluorescent lamp which is supplied with a.c. electrical current, wherein said method consists in periodically supplying said lamp with the electrical current which is pulsed to flash the lamp to be visible to an observer during an emitting time T1 of the electrical current which is selected so that the cyclic ratio T1/T, where T is the pulsating period, is comprised between 0 and 1, and whose corresponding frequency 1/T is comprised between 1 and 500 Hz; and moving the lamp in accordance with a relative moving speed V in space such as $0<V\leqq 50$ m/s or $0<V\leqq 50$ rps.

2. A method according to claim 1, wherein the cyclic ratio is comprised between 0.01 and 0.99 and said frequency is comprised between 0.2 and 100 Hz, in the case where said lamp is mechanically moved in rotation or along a predetermined path.

3. A method according to claim 1, wherein said cyclic ratio is comprised between 0.05 and 0.9, said frequency is comprised between 10 and 50 Hz and said moving speed V is comprised between 0 and 5 m/s or 0 and 10 rps, in the case where said lamp is manually moved.

4. A method according to claim 1, wherein said lamp is moved with respect to an observer.

5. A method according to claim 1, wherein an observer moves with respect to said lamp.

6. A method according to claim 1, wherein said movement is provided by disposing an object which moves between an observer and said lamp.

7. A device for forming special color effects comprising a transformer for power supplying a fluorescent lamp, whose electrodes are disposed in a secondary winding circuit thereof, a power stage disposed in a primary winding circuit of said transformer, an oscillating circuit connected to the input of said power stage and delivering thereto a fixed frequency current for supplying an AC electrical current to flash said lamp to be visible to an observer, a semi-conductor element capable of periodically operating said oscillating circuit and a generation for generating a square-wave signal and connected to said semi-conductor element which is rendered conductive during a time T1 selected so that the cyclic ratio T1/T, where T is the period of the square-wave signal, is comprised between 0 and 1, the frequency of the square-wave signal being comprised between 1 and 500 Hz.

8. A device according to claim 7, further comprising an adjustable oscillator generating triangular signals of relatively low frequency controlling said square-wave signal generator, the frequency of the triangular and square-wave signals being equal.

9. A device according to claim 7, wherein said generator comprises a variable resistance for adjusting said cyclic ratio.

10. A device according to claim 7, wherein said semi-conductor element is a diode.

11. A device according to claim 7, wherein it is power-supplied from at least one battery.

12. A device according to claim 7, wherein it is power-supplied from the network current.

13. A device according to claim 7, wherein it is in the form of a stick comprising a handle part in which are housed the different electronic circuits and the supply source, and a protective tube which is fixed to the handle part and in which is housed said lamp.

14. A device according to claim 7, wherein said lamp is protected by a protective screen which is transparent or semi-transparent, colored or not.

15. A device according to claim 7, wherein said lamp is fixed to a rotating wheel.

16. A device according to claim 7, wherein said lamp is fixed to an oscillating device.

17. A device according to claim 7, wherein said lamp contains at least a gas, and is provided with a fluorescent settling constituted by one or several fluorescent materials for forming supplementary special effects of color due to the difference of retentivity of the different materials during time.

18. A device according to claim 7, wherein the lighting part of said lamp seen by an observer has a width below 40 mm.

* * * * *